US010978227B2

(12) United States Patent
Herzer et al.

(10) Patent No.: US 10,978,227 B2
(45) **Date of Patent: *Apr. 13, 2021**

(54) ALLOY, MAGNETIC CORE AND PROCESS FOR THE PRODUCTION OF A TAPE FROM AN ALLOY

(71) Applicant: Vacuumschmelze GmbH & Co. KG, Hanau (DE)

(72) Inventors: Giselher Herzer, Bruchkoebel (DE); Christian Polak, Blackenbach (DE); Viktoria Budinsky, Freigericht (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/217,771

(22) Filed: Jul. 22, 2016

(65) Prior Publication Data

US 2016/0329140 A1 Nov. 10, 2016

Related U.S. Application Data

(63) Continuation of application No. 13/447,780, filed on Apr. 16, 2012, now Pat. No. 9,773,595.
(Continued)

(51) Int. Cl.
*H01F 1/147* (2006.01)
*H01F 27/25* (2006.01)
(Continued)

(52) U.S. Cl.
CPC ..... *H01F 1/14766* (2013.01); *C21D 8/1272* (2013.01); *C21D 9/56* (2013.01);
(Continued)

(58) Field of Classification Search
None
See application file for complete search history.

(56) References Cited

U.S. PATENT DOCUMENTS 7,583,173 B2 9/2009 Waeckerle et al.
10,347,405 B2 * 7/2019 Herzer ..... H01F 1/047
(Continued)

FOREIGN PATENT DOCUMENTS

CN 1555071 A 12/2004
CN 101371321 A 2/2009
(Continued)

OTHER PUBLICATIONS

Machine translation of JP2008-196006A, Aug. 2008.*
(Continued)

*Primary Examiner* — Xiaowei Su
(74) *Attorney, Agent, or Firm* — Dickinson Wright PLLC

(57) ABSTRACT

An alloy is provided which consists of $Fe_{100-a-b-c-d-x-y-z}Cu_aNb_bM_c\ T_dSi_xB_yZ_z$ and up to 1 at % impurities, M being one or more of the elements Mo, Ta and Zr, T being one or more of the elements V, Mn, Cr, Co and Ni, Z being one or more of the elements C, P and Ge, 0 at %≤a<1.5 at %, 0 at %≤b<2 at %, 0 at %≤(b+c)<2 at %, 0 at %≤d<5 at %, 10 at %<x<18 at %, 5 at %<y<11 at % and 0 at %≤z<2 at %. The alloy is configured in tape form and has a nanocrystalline structure in which at least 50 vol % of the grains have an average size of less than 100 nm, a hysteresis loop with a central linear region, a remanence ratio Jr/Js of <0.1 and a coercive field strength $H_c$ to anisotropic field strength Ha ratio of <10%.

13 Claims, 11 Drawing Sheets

Related U.S. Application Data

(60) Provisional application No. 61/475,749, filed on Apr. 15, 2011.

(51) Int. Cl.

| | |
|---|---|
| ***C22C 38/00*** | (2006.01) |
| ***C22C 45/02*** | (2006.01) |
| ***H01F 1/153*** | (2006.01) |
| ***H01F 41/02*** | (2006.01) |
| ***C21D 8/12*** | (2006.01) |
| ***C21D 9/56*** | (2006.01) |
| ***C22C 38/02*** | (2006.01) |
| ***C22C 38/12*** | (2006.01) |
| ***C22C 38/16*** | (2006.01) |

(52) U.S. Cl.

CPC ..... *C22C 38/00* (2013.01); *C22C 38/02* (2013.01); *C22C 38/12* (2013.01); *C22C 38/16* (2013.01); *C22C 45/02* (2013.01); *H01F 1/14708* (2013.01); *H01F 1/15308* (2013.01); *H01F 1/15333* (2013.01); *H01F 41/0226* (2013.01); *C21D 2201/03* (2013.01); *Y10T 428/12431* (2015.01)

(56) References Cited

U.S. PATENT DOCUMENTS

| | | | | |
|---|---|---|---|---|
| 2008/0196795 | A1* | 8/2008 | Waeckerle | H01F 1/153 148/540 |
| 2010/0108196 | A1 | 5/2010 | Ohta et al. | |
| 2010/0265028 | A1 | 10/2010 | McHenry et al. | |
| 2012/0262266 | A1* | 10/2012 | Herzer | C22C 38/00 336/233 |
| 2014/0104024 | A1* | 4/2014 | Herzer | H01F 1/047 335/297 |
| 2014/0152416 | A1* | 6/2014 | Herzer | H01F 1/15333 336/233 |
| 2015/0255203 | A1* | 9/2015 | Herzer | C21D 8/1238 336/233 |

FOREIGN PATENT DOCUMENTS

| | | | | | |
|---|---|---|---|---|---|
| CN | 101373653 | A | | 2/2009 | |
| EP | 0271657 | A2 | | 6/1988 | |
| EP | 0695812 | A1 | | 2/1996 | |
| EP | 1724792 | A1 | | 11/2006 | |
| JP | S5834162 | A | | 2/1983 | |
| JP | H0867911 | A | | 3/1996 | |
| JP | 11080908 | A | | 3/1999 | |
| JP | 2008196006 | A | * | 8/2008 | C22C 45/02 |
| WO | 2004088681 | A2 | | 10/2004 | |

OTHER PUBLICATIONS

Herzer (IEEE Transactions on Magnetics, 2010, vol. 46, p. 341-344).*

Zeng, J. Magnetism and Magnetic Materials, vol. 208, p. 74-77. (Year: 2000).*

Japanese Office Action for Application No. 2014-504421 dated Oct. 20, 2015 with English Translation (previously cited in IDS filed Sep. 30, 2017 without English Translation).

Chinese Office Action for Application No. 2012800178802 dated Jun. 10, 2014.

Kulik et al. (Journal of Magnetism and Magnetic Materials, 1996, vol. 160, p. 269-270).

Giselher Herzer, "Nanocrystalline Soft Magnetic Alloys," Handbook of Magnetic Materials, vol. 10, Elsevier Science B. V., 1997, pp. 415-462.

Yang et al. Magneto-impedance effect in field- and stress-annealed Fe-based nanocrystalline alloys, Journal of Magnetism and Magnetic Materials, 1997, vol. 175, p. 285-289.

Japanese Office Action for Application No. 2014-504421 dated Oct. 20, 2015.

Korean Office Action with translation corresponding to Korean Application No. 10-2013-7025209 dated May 29, 2018.

* cited by examiner

ALLOY, MAGNETIC CORE AND PROCESS FOR THE PRODUCTION OF A TAPE FROM AN ALLOY

CROSS-REFERENCE TO RELATED APPLICATIONS

This application is a continuation of U.S. patent application Ser. No. 13/447,780 filed on Apr. 16, 2012. The entire disclosure(s) of (each of) the above application(s) is (are) incorporated herein by reference. This application claims benefit of the filing date of U.S. Provisional Patent Application No. 61/475,749, filed Apr. 15, 2011, the entire contents of which are incorporated herein by reference.

BACKGROUND

1. Field

Disclosed herein is an alloy, in particular a soft magnetic alloy suitable for use as a magnetic core, a magnetic core and a process for producing a tape from an alloy.

2. Description of Related Art

Nanocrystalline alloys based on a composition of $Fe_{100-a-b-c-d-x-y-z}Cu_aNb_bM_c\ T_dSi_xB_yZ_z$ can be used as magnetic cores in various applications. U.S. Pat. No. 7,583,173 discloses a wound magnetic core which is used amongst other applications in a current transformer and which consists of $(Fe_{1-a}Ni_a)_{100-x-y-z-a-b-c}Cu_xSi_yB_zNb_\alpha M'_\beta M''_\gamma$, where $a \leq 0.3$, $0.6 \leq x \leq 1.5$, $10 \leq y \leq 17$, $5 \leq z \leq 14$, $2 \leq \alpha \leq 6$, $\beta \leq 7$, $\gamma \leq 8$, M' is at least one of the elements V, Cr, Al and Zn, and M" is at least one of the elements C, Ge, P, Ga, Sb, In and Be. EP 0 271 657 A2 also discloses alloys based on a similar composition.

These alloys, also in the form of a tape, can be used as magnetic cores in various components such as, for example, power transformers, current transformers and storage chokes.

In general, it is desirable to achieve the lowest production costs possible in magnetic core applications. However, such cost reductions should, where possible, have no or only minimal impact on the functionality of the magnetic cores.

In some magnetic core applications it is desirable to further reduce the size and weight of the magnetic cores in order to further reduce the size and weight of the component itself. At the same time, however, any increase in production costs is undesirable.

Therefore, there is a need in the art to provide an alloy suitable for use as a magnetic core which can be produced more cost effectively. It is additionally desirable that the alloys used in such a manner are such that the size and/or weight of the magnetic core can be reduced in comparison to conventional magnetic cores.

SUMMARY

One or more of the embodiments disclosed herein satisfy one or more of these needs in the art, as described in more detail below.

One embodiment disclosed herein relates to an alloy consisting of $Fe_{100-a-b-c-d-x-y-z}Cu_aNb_bM_c\ T_dSi_xB_yZ_z$ and up to 1 at % impurities. M is one or more of the elements Mo, Ta and Zr, T is one or more of the elements V, Mn, Cr, Co and Ni, Z is one or more of the elements C, P and Ge, and 0 at % $\leq a < 1.5$ at %, 0 at % $\leq b \leq 2$ at %, 0 at % $\leq (b+c) < 2$ at %, 0 at % $\leq d < 5$ at %, 10 at % $< x < 18$ at %, 5 at % $< y < 11$ at % and 0 at % $\leq z < 2$ at %. In a particular embodiment, the alloy is configured in the form of a tape and comprises a nanocrystalline structure in which at least 50 vol % of the grains have an average size of less than 100 nm. The alloy also comprises a hysteresis loop with a central linear region, a remanence ratio $J_r/J_s < 0.1$ and a ratio of coercive field strength $H_c$ to anisotropic field strength $H_a$ of <10%.

Embodiments of the alloy thus have a composition with a niobium content of less than 2 at %. Since niobium is a relatively expensive element, this has the advantage that the raw materials costs are lower than for a composition with a higher niobium content. In addition, the lower silicon content limit and upper boron content limit of the alloy are set such that the alloy can be produced in tape form under tensile stress in a continuous furnace, thereby achieving the aforementioned magnetic properties. It is therefore possible using this production process for the alloy to have the soft magnetic properties desired for magnetic core applications despite the lower niobium content.

The tape form not only permits the alloy to be produced under tensile stress in a continuous furnace, it also allows a magnetic core to be produced with any number of turns. The size and magnetic properties of the magnetic core can therefore be adjusted to the application simply by means of appropriate selection of turns. The nanocrystalline structure which has a grain size of less than 100 nm in at least 50 vol % of the alloy produces low saturation magnetostriction at high saturation polarisation. By suitable alloy selection of an alloy, heat treatment under tensile stress results in a magnetic hysteresis loop with a central linear region, a remanence ratio of less than 0.1 and a coercive field strength of less than 10% of the anisotropic field. This combines low hysteresis losses and a permeability value largely independent of the magnetic field applied and/or pre-magnetisation in the linear central region of the hysteresis loop, both of which are desirable in magnetic cores for applications such as current transformers, power transformers and storage chokes.

For the purposes disclosed herein, the central region of the hysteresis loop is defined as the region of the hysteresis loop between the anisotropic field strength points which characterise the transition to saturation. Similarly, a linear region of this central region of the hysteresis loop is defined by a non-linearity factor NL of less than 3%, the non-linearity factor being calculated as follows:

$$NL(\%)=100(\delta J_{up}+\delta J_{down})/(2J_s) \quad (1)$$

where $\delta J_{up}$ and $\delta J_{down}$ are the standard deviation of magnetisation from a line of best fit through the rising (up) or falling (down) branches of the hysteresis loop between magnetisation values of ±75% of saturation polarisation $J_s$.

These embodiments of the alloy are thus particularly suitable for a magnetic core which is smaller, weighs less and thus has lower raw materials costs and also has the desired soft magnetic properties for use as a magnetic core.

In one embodiment, the remanence ratio of the alloy is less than 0.05. The hysteresis loop of the alloy is thus even more linear or flatter. In another embodiment the ratio of coercive field strength to anisotropic field strength is less than 5%. In this embodiment, too, the hysteresis loop is even more linear and hysteresis losses therefore even lower.

In one embodiment the alloy also has a permeability μ of 40 to 3000 or 80 to 1500. In another embodiment the alloy has a permeability of between approximately 200 and 9000. In these and other examples permeability is determined primarily by setting tensile stress during heat treatment.

Here the tensile stress can be up to approximately 800 MPa without the tape breaking. It is therefore possible with a predetermined composition to cover a tape with a permeability within a total permeability range of $\mu$=40 to approximately $\mu$=10000. This results in particularly linear loops in regions of low permeability, i.e. approximately $\mu$=40 to 3000.

Such relatively low permeabilities are advantageous for current transformers, power transformers, choking coils and other applications in which ferromagnetic saturation of the magnetic core needs to be avoided to prevent inductivity losses when high electric currents pass through coils around the magnetic core.

The specific requirements of the various applications dictate suitable permeability ranges. Suitable ranges are 1500 to 3000, 200 to 1500 and 50 to 200. Thus, for example, a permeability $\mu$ of approximately 1500 to approximately 3000 is advantageous for DC current transformers, while a permeability range of approximately 200 to 1500 is particularly suitable for power transformers and a permeability range of approximately 50 to 200 is particularly suitable for storage chokes.

The lower the permeability, the higher can be the electrical currents passing through the turns of the magnetic core without saturating the material. Similarly, at identical permeability the higher the saturation polarisation Js of the material, the higher these currents can be. In contrast, the inductivity of the magnetic core increases with permeability and size. In order to construct magnetic cores with both high inductivity and high current tolerance it is therefore advantageous to use alloys with higher saturation polarisation levels. In one embodiment, for example, saturation polarisation is increased from $J_s$=1.21 T to $J_s$=1.34 T, i.e. by more than 10%, by reducing the niobium content. This can be exploited to reduce the size and weight of the core without losses.

The alloy can have a saturation magnetostriction in terms of amount of less than 5 ppm. Alloys with a saturation magnetostriction below this limit value have particularly good soft magnetic properties even where there is internal stress, particularly where permeability is not significantly greater than 500. At higher permeabilities it is advantageous to select alloys with lower saturation magnetostriction values.

Moreover, the alloy can have a saturation magnetostriction in terms of amount of less than 2 ppm, preferably less than 1 ppm. Alloys with a saturation magnetostriction below this limit value have particularly good soft magnetic properties even where there is internal stress, particularly if the permeability p is greater than 500 or greater than 1000.

In one embodiment, the alloy is niobium-free, i.e. b=0. This embodiment has the advantage that the raw materials costs are further reduced since niobium is omitted entirely.

In a further embodiment, the alloy is copper-free, i.e. a=0. In a further embodiment the alloy is niobium- and copper-free, i.e. a=0 and b=0.

In further embodiments, the alloy comprises niobium and/or copper with $0<a\leq 0.5$ and $0<b\leq 0.5$.

In further embodiments, the silicon and/or boron contents are also defined, the alloy comprising 14 at %<x<17 at % and/or 5.5 at %<y<8 at %.

As already mentioned above, the alloy has the form of a tape. This tape can have a thickness of 10 μm to 50 μm. This thickness allows a magnetic core to be wound with a high number of turns and also to have a small external diameter.

In a further embodiment at least 70 vol % of the grains have an average size of less than 50 nm. This permits a further increase in magnetic properties.

In a particular embodiment, alloy is heat treated in tape form under tensile stress to generate the desired magnetic properties. The alloy, i.e. the finished heat treated tape, is thus also characterised by the structure created by this production process. In one embodiment the crystallites have an average size of approximately 20-25 nm and a remanent elongation along the tape of between approximately 0.02% and 0.5% which is proportionate to the tensile stress applied during heat treatment. For example, heat treatment under a tensile stress of 100 MPa leads to an elongation of approximately 0.1%.

In a particular embodiment, the crystalline grains can have an elongation of at least 0.02% in a preferred direction.

A magnetic core made of an alloy as disclosed in one of the preceding embodiments is also provided. The magnetic core can take the form of a wound tape in which case the tape can be wound in one plane or as a solenoid about an axis to form the magnetic core depending on the application.

The tape of the magnetic core can be coated with an insulating layer to electrically insulate the turns of the magnetic core from one another. The layer can, for example, be a polymer layer or a ceramic layer. The tape can be coated with the insulating layer before and/or after it is wound to form a magnetic core.

As already mentioned, the magnetic core disclosed in one of the preceding embodiments can be used in various components. A power transformer, a current transformer and a storage choke with a magnetic core as disclosed in one of these embodiments are also provided.

A process for producing a tape comprising the following: provision of a tape made of an amorphous alloy with a composition of $Fe_{100-a-b-c-d-x-y-z}Cu_aNb_bM_c\ T_dSi_xB_yZ_z$ and up to 1 at % impurities, M being one or more of the elements Mo, Ta and Zr, T being one or more of the elements V, Mn, Cr, Co and Ni, Z being one or more of the elements C, P and Ge, 0 at %≤a<1.5 at %, 0 at %≤b<2 at %, 0 at %≤(b+c)<2 at %, 0 at %≤d<5 at %, 10 at %<x<18 at %, 5 at %<y<11 at % and 0 at %-z<2 at %. This tape is heat treated under tensile stress in a continuous furnace at a temperature $T_a$ where 450° C.≤Ta≤750° C.

This composition can be produced with suitable magnetic properties for use as a magnetic core by means of heat treatment at between 450° C. and 750° C. under tensile stress. The heat treatment leads to the formation of a nanocrystalline structure in which the average size of at least 50 vol % of the grains is less than 100 nm. In particular, this process can be used to produce this composition comprising less than 2 at % niobium so as to obtain a hysteresis loop with a central linear region, a remanence ratio $J_r/J_s$<0.1 and a ratio of coercive field strength $H_c$ to anisotropic field strength $H_a$ of <10%.

In an embodiment, the tape is heat treated continuously. As a result, the tape is passed through a continuous furnace at a speed s. This speed s can be set such that the length of time the tape spends in a temperature zone of the continuous furnace with a temperature within 5% of temperature $T_a$ is between 2 seconds and 2 minutes. In this process the length of time required to heat the tape to temperature $T_a$ is of an order of magnitude comparable to the length of the heat treatment itself. The same applies for the length of the subsequent cooling period. Heat treatment for this length of time in this annealing temperature range produces the desired structure and the desired magnetic properties.

In one embodiment the tape is passed through the continuous furnace under a tensile stress of between 5 and 160 MPa. In a further embodiment the tape is passed through the continuous furnace under a tensile stress of 20 MPa to 500 MPa. It is also possible to pass the tape through the oven at a higher tensile stress of up to approximately 800 MPa without it breaking. This tensile stress range is suitable for achieving the desired magnetic properties with the aforementioned compositions.

The value of the permeability μ achieved is inversely proportionate to the tensile stress $\sigma_a$ applied during heat treatment. A tensile stress Ga which satisfies the equation $\sigma_a \approx \alpha/\mu$ is therefore required during heat treatment in order to achieve a predetermined relative permeability value μ. In one embodiment a has a value of $\alpha \approx 48000$ MPa. In another embodiment, for example, a has a value of $\alpha \approx 36000$ MPa. Thus values in the range $\alpha \approx 30000$ MPa to $\alpha \approx 70000$ MPa can be used for the alloys disclosed in the invention and the corresponding heat treatment process. The exact value of α depends in each individual case on composition, annealing temperature and to a certain extent on annealing time.

The tensile stress which produces the desired magnetic properties can therefore be dependent on the composition of the alloy and the annealing temperature as well as on the annealing time. In one embodiment the tensile stress $\sigma_a$ required for a predetermined permeability μ is selected from the permeability $\mu_{Test}$ of a test annealing process under a tensile stress $\sigma_{Test}$ in accordance with the equation $$\sigma_a \approx \sigma_{Test} \mu_{Test}/\mu.$$

The desired magnetic properties can also be dependent on the annealing temperature $T_a$ and can thus be set by selecting the annealing temperature. In one embodiment the temperature $T_a$ is selected dependent on the niobium content b in accordance with the equation $(T_{x1}+50°\ C.) \leq Ta \leq (T_{x2}+30°\ C.)$. Here $T_{x1}$ and $T_{x2}$ correspond to the crystallisation temperatures defined by the maximum transformation heat and are determined by means of standard thermal methods such as Differential Scanning calorimetry (DSC) at a heating rate of 10 K/min.

In a further embodiment a desired permeability or anisotropic field strength value and a permitted deviation range are predetermined. To achieve this value along the length of the tape, the magnetic properties of the tape are measured continuously as it leaves the continuous furnace. When deviations from the permitted deviation ranges are observed, the tensile stress at the tape is adjusted to bring the measured values of the magnetic properties back into the permitted deviation ranges.

This embodiment reduces deviations in the magnetic properties along the length of the tape, thereby making the magnetic properties within a magnetic core more homogenous and/or reducing deviations in the magnetic properties of a plurality of magnetic cores made of the same tape. Thus it is possible to improve the regularity of the soft magnetic properties of the magnetic cores, in particular in commercial production.

BRIEF DESCRIPTION OF DRAWINGS

Embodiments are explained in greater detail below with reference to the following figures, which are intended to illustrate certain features of certain embodiments of the appended claims, and not to limit them.

DETAILED DESCRIPTION OF EXAMPLE EMBODIMENTS

Features of particular embodiments of alloy disclosed herein are shown in the tables, which are summarized below. Table 1 shows the non-linearity factor NL for different Nb contents of the alloy $Fe_{77-x}Cu_1Nb_xSi_{15.5}B_{6.5}$ after heat treatment in the magnetic field (control example) and after heat treatment under a mechanical tensile stress (process according to the invention).

Table 2 shows measured crystallisation temperatures and suitable annealing temperatures Ta for annealing times of approximately 2 s to 10 s for different Nb contents of the alloy $Fe_{77-x}Cu_1Nb_xSi_{15.5}B_{6.5}$.

Table 3 shows magnetic properties of an alloy $Fe_{76}Cu_1Nb_{1.5}Si_{13.5}B_8$ after heat treatment in a continuous furnace at 610° C. under a tensile stress of approximately 120 MPa as a function of the annealing time $t_a$.

Table 4 shows magnetic properties of an alloy $Fe_{76}Cu_{0.5}Nb_{15}Si_{15.5}B_{6.5}$ after heat treatment with the specified tensile stress $\sigma_a$.

Table 5 shows a saturation polarisation level $J_s$ measured in the manufactured state, and non-linearity NL, remanence ratio $J_r/J_s$, coercive field strength $H_c$, anisotropic field strength $H_a$ and relative permeability μ values measured at different annealing temperatures $T_a$ after heat treatment of different alloy compositions.

Table 6 shows a saturation polarisation level $J_s$ measured in the manufactured state and non-linearity NL, remanence ratio $J_r/J_s$, coercive field strength $H_c$, anisotropic field strength $H_a$ and relative permeability μ values measured after heat treatment of different alloy compositions.

Table 7 shows the saturation magnetostriction $\lambda_s$ of different alloy compositions measured in the manufactured state and after heat treatment under stress at the specified annealing temperature $T_a$.

The features of the alloy, magnetic cores and applications therefore disclosed herein can be more clearly understood by reference to the following specific embodiments, which are intended to be illustrative, and not limiting, of the appended claims.

Figure 1:
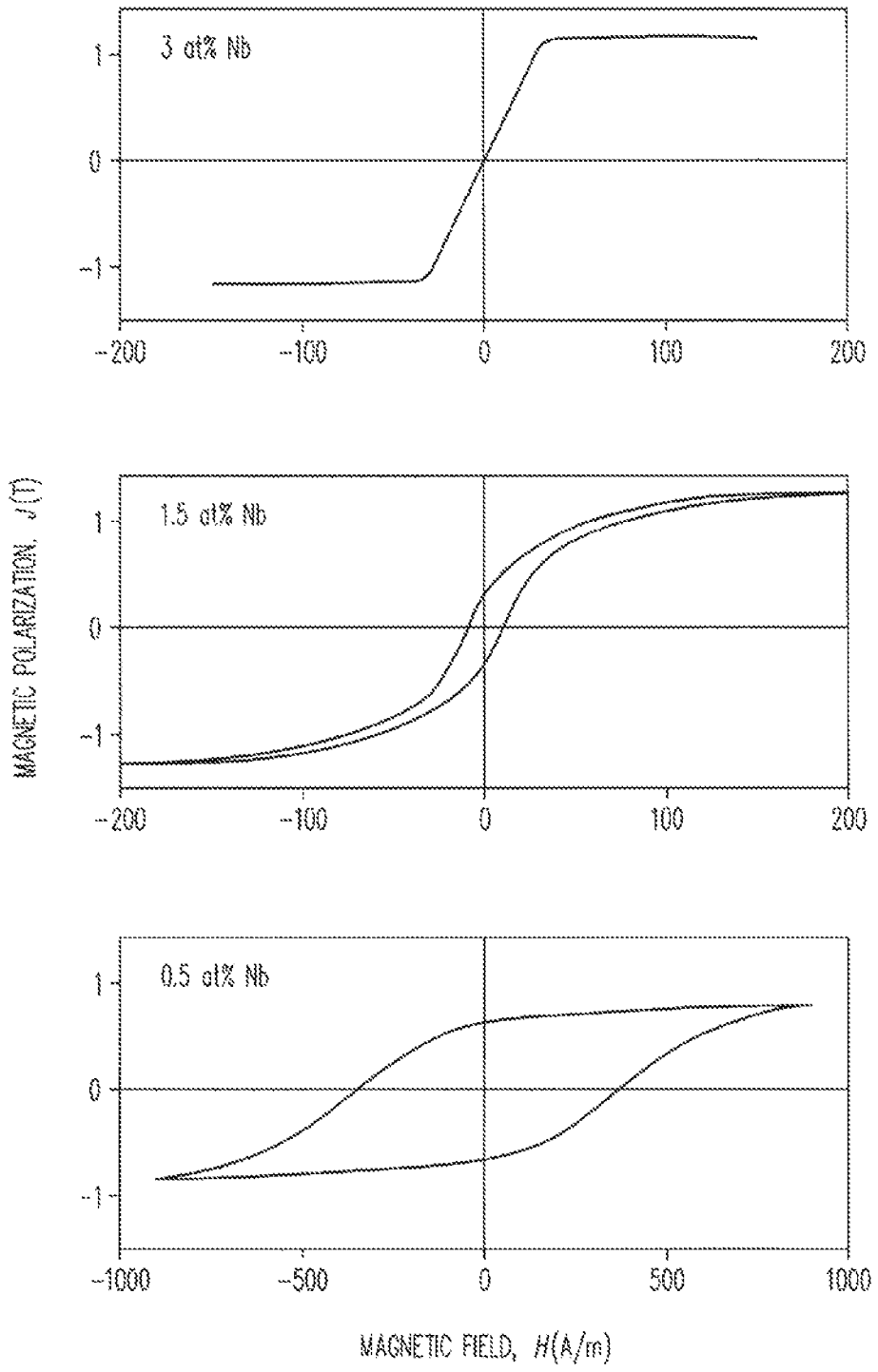
FIG. 1 shows a diagram of hysteresis loops for control examples of nanocrystalline $Fe_{77-x}Cu_1Nb_xSi_{15.5}B_{6.5}$ with different niobium contents after heat treatment in a magnetic field perpendicular to the length of the tape.

FIG. 1 shows a diagram of hysteresis loops for a particular embodiment of nanocrystalline alloys in the form of a tape.

The tests were carried out by way of example on metal tapes 6 mm and 10 mm wide and typically 17 μm to 25 μm thick. However, the inventive idea is not restricted to these dimensions.

The exemplary tapes have a composition of $Fe_{77-x}Cu_1Nb_xSi_{15.5}B_{6.5}$. The hysteresis loops are measured after heat treatment in the magnetic field, heat treatment being carried out for 0.5 h at 540° C. in a magnetic field of H=200 kA/m perpendicular to the length of the tape. FIG. 1 shows that the hysteresis loops become more non-linear as the Nb content falls. This non-linear hysteresis loop is undesirable in some magnetic core applications as losses due to hysteresis are increased.

Figure 2:
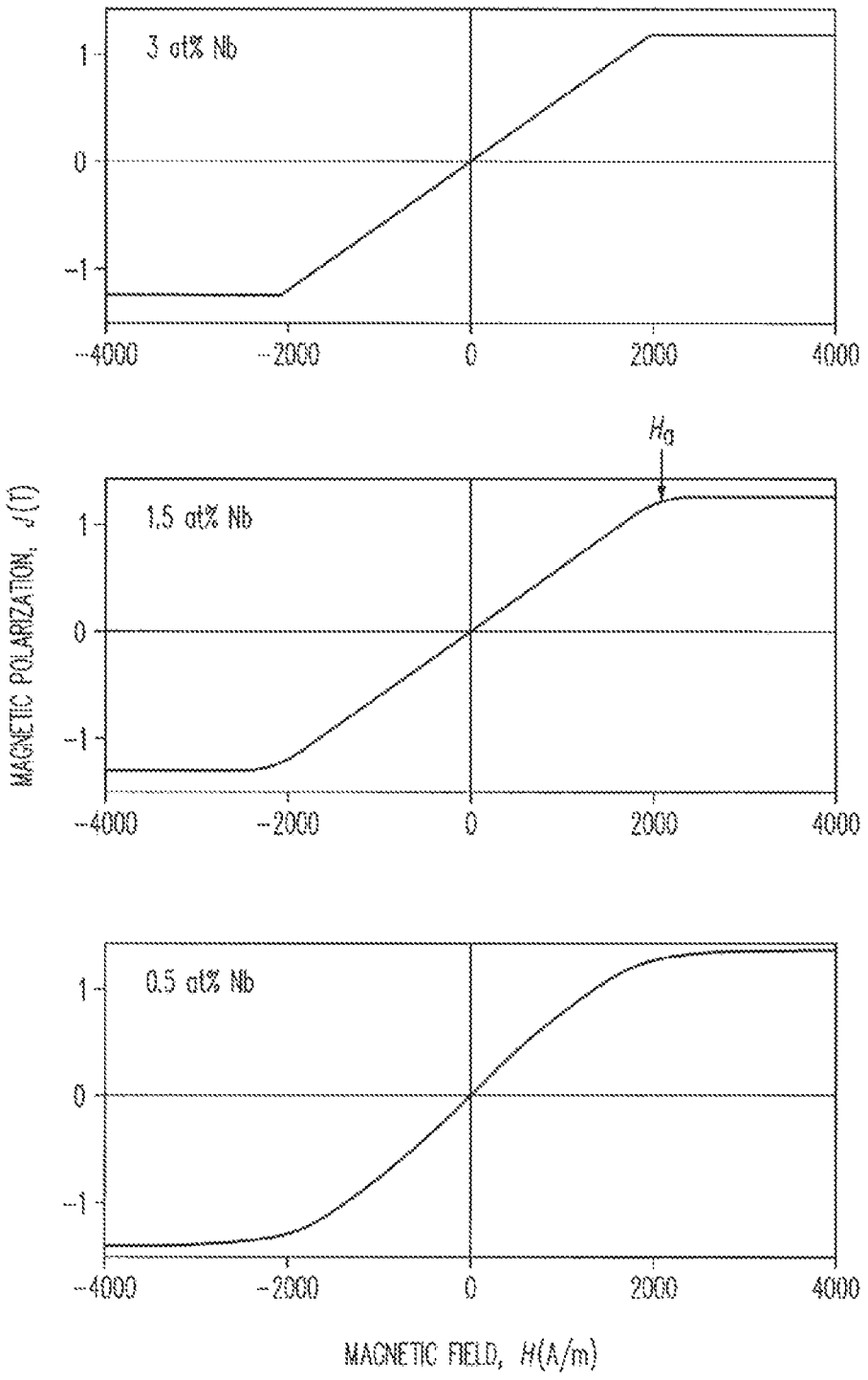
FIG. 2 shows a diagram of hysteresis loops for nanocrystalline $Fe_{77-x}Cu_1Nb_xSi_{15.5}B_{6.5}$ after heat treatment under tensile stress applied along the length of the tape for different niobium contents.

Table 1 shows the non-linearity factors NL for the hysteresis loops shown in FIGS. 1 and 2 for different heat treatments and different Nb contents. In particular, Table 1 shows the non-linearity factor for nanocrystalline $Fe_{77-x}Cu_1Nb_xSi_{15.5}B_{6.5}$ after heat treatment in the magnetic field for 0.5 h at a temperature of 540° C. and after heat treatment under a tensile stress of 100 MPa for 4 s at 600° C. for different Nb contents.

TABLE 1

| | Non-linearity factor NL (%) | |
|---|---|---|
| Nb (at %) | 0.5 h 540° C. in the magnetic field | 4 s 600° C. under stress (100 MPa) |
| 0.5 | 16(1) | 1.8(2) |
| 1.5 | 10(1) | 0.4(2) |
| 3 | 0.4(1) | 0.1(1) |

(1)Control example
(2)Example according to the invention

Figure 3:
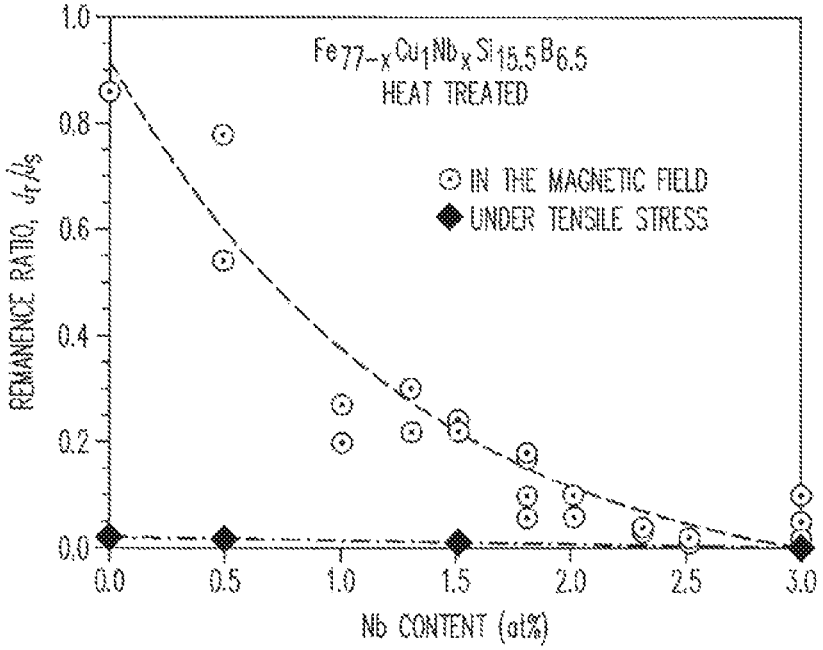
FIG. 3 shows a diagram of the remanence ratio of nanocrystalline $Fe_{77-x}Cu_1Nb_xSi_{15.5}B_{6.5}$ after heat treatment in a magnetic field and after heat treatment under tensile stress as a function of the Nb content.

FIG. 3 shows a diagram of the remanence ratio $J_r/J_s$ of heat treated samples as a function of the Nb content. In particular, FIG. 3 shows the remanence ratio of nanocrystalline $Fe_{77-x}Cu_1Nb_xSi_{15.5}B_{6.5}$ after heat treatment in the magnetic field for 0.5 h at temperatures of 480° C. to 540° C. and after heat treatment under tensile stress of at temperatures of between 520° C. and 700° C. as a function of the Nb content.

In case of heat treatment in the magnetic field, as indicated by white circles in FIG. 3, particularly linear loops with a remanence ratio of less than 0.1 and a non-linearity factor of less than 3% are reliably obtained only with Nb contents greater than 2 at %. In case of heat treatment under tensile stress, by contrast, linear loops with a remanence ratio of less than 0.1 and a non-linearity factor of less than 3% can be reliably achieved with Nb contents of less than 2 at % and even for compositions without niobium.

The results illustrated in FIGS. 1 and 3 show that, if the heat treatment is carried out in a magnetic field, a minimum Nb content of preferably more than 2 at % is required to produce a tape with magnetic properties suitable for use as a magnetic core. Tables 1 to 6 and FIGS. 2 to 12 show that, if the heat treatment takes place under mechanical tensile stress along the tape, linear loops with small remanence ratios can be achieved in compositions with a niobium content of less than 2 at %. Since niobium is a relatively expensive element, these compositions have the advantage of reduced raw materials costs.

FIG. 2 shows a diagram of hysteresis loops for tapes after heat treatment in a continuous furnace with an effective annealing time of 4 s at a temperature of 600° C. and under a tensile stress of approximately 100 MPa.

For purposes of this application, annealing time in the continuous furnace is defined as the period during which the tape passes through the temperature zone in which the temperature is within 5% of the annealing temperature specified here. The length of time required to heat the tape to the annealing temperature is typically of an order of magnitude comparable to that of the length of the heat treatment itself.

FIG. 2 shows that it is possible to obtain hysteresis loops with a central linear region and a small remanence ratio for Nb contents of less than 2 at %. The composition comprising 3 at % Nb is a control example and the compositions with Nb<2 at % are the examples according to the invention. The arrow shows the definition of the anisotropic field strength $H_a$ by way of example.

FIG. 3 shows a diagram of a comparison between the remanence ratios of samples tempered under tensile stresses, such as those indicated by black diamonds in FIG. 3, and those of samples tempered in a magnetic field, as indicated by white circles, as a function of the Nb content. Alloys with Nb contents of less than 2 at % have small remanence ratios of less than 0.05 only when they are heat treated under tensile stress. If these compositions are tempered in a magnetic field, however, the remanence ratio is significantly higher and such alloys are therefore unsuitable for some magnetic core applications. Even the alloy $Fe_{77}Cu_1Si_{15.5}B_{6.5}$, i.e. containing no added Nb, produces a largely linear loop with a remanence ratio of less than 0.05 if heat treated under tensile stress.

Figure 4:
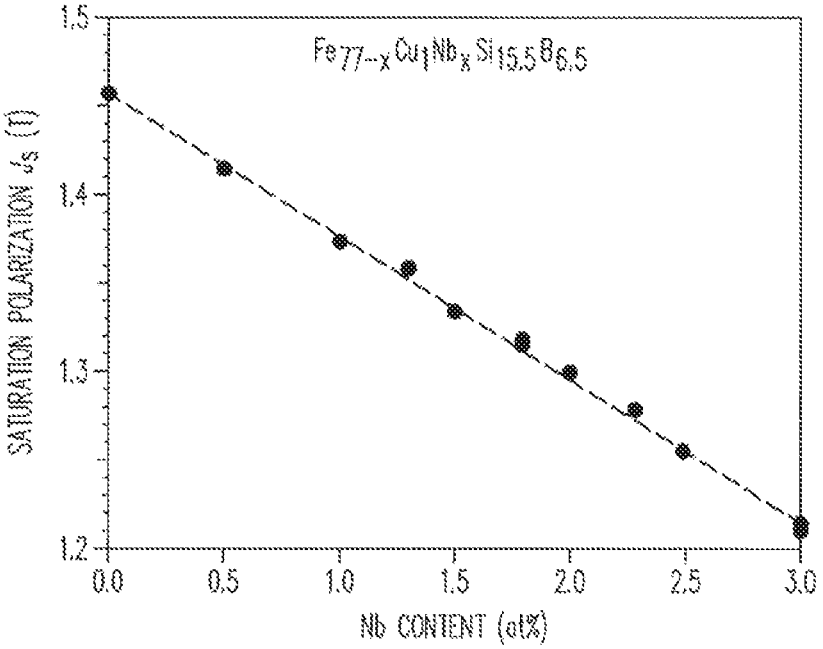
FIG. 4 shows a diagram of the saturation polarisation of $Fe_{77-x}Cu_1Nb_xSi_{15.5}B_{6.5}$ as a function of the Nb content.

FIG. 4 shows a diagram of the saturation polarisation of alloys with a composition of $Fe_{77-x}Cu_1Nb_xSi_{15.5}B_{6.5}$ as a function of the Nb content. Alloys with a reduced Nb content have a significantly higher saturation polarisation. This can advantageously be used to reduce both weight and production costs. In addition to reduced raw materials costs it also provides a further advantage in that the device containing the magnetic core can be made smaller.

Figure 5:
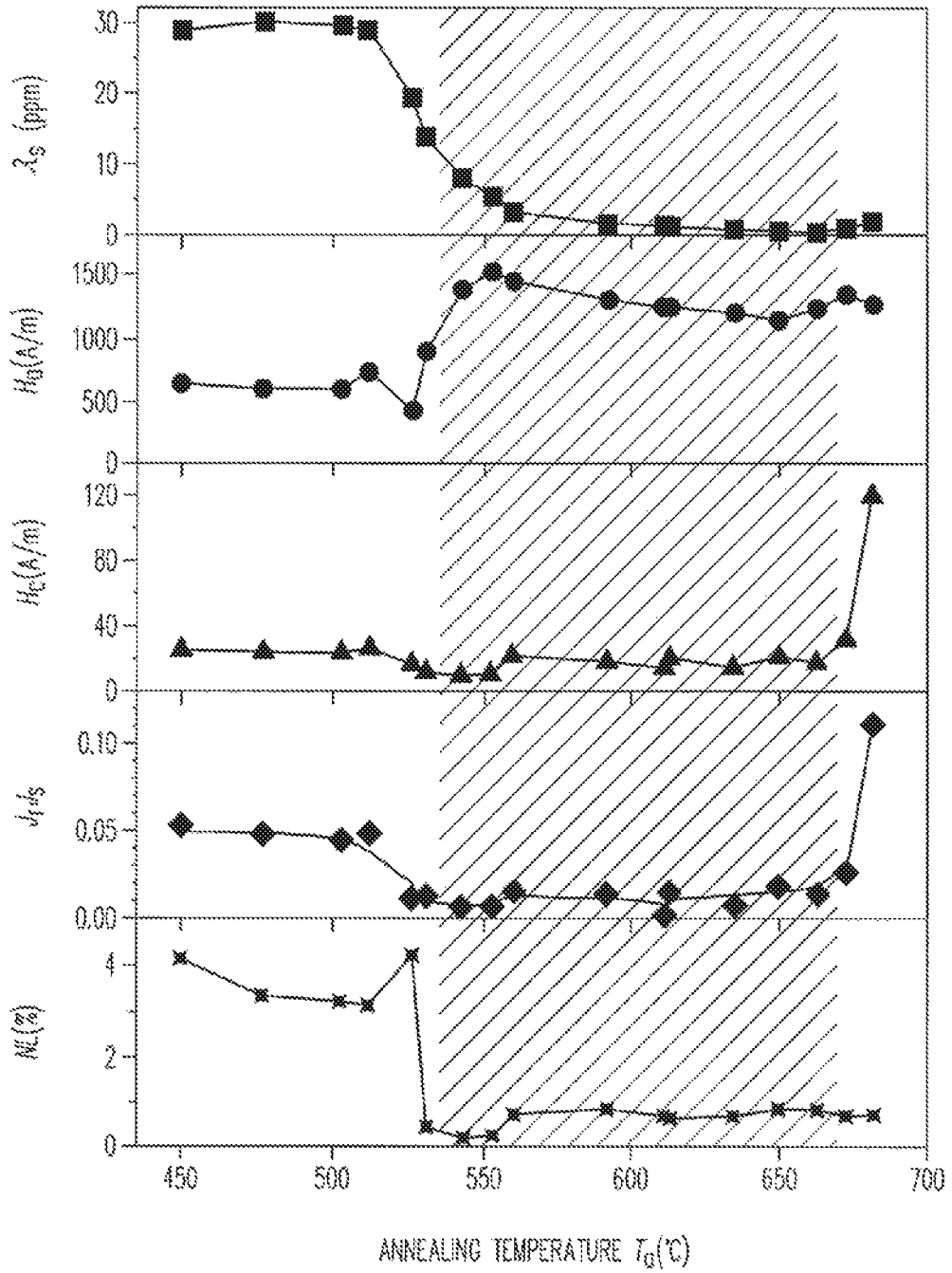
FIG. 5 shows a diagram of the saturation magnetostriction $\lambda_s$, anisotropic field $H_a$, coercive field strength $H_c$, remanence ratio $J_r/J_s$ and non-linearity factor NL of $Fe_{75.5}Cu_1Nb_{1.5}Si_{15.5}B_{6.5}$ after heat treatment under tensile stress at different annealing temperatures.

FIG. 5 shows a diagram of the saturation magnetostriction $\lambda_s$, anisotropic field $H_a$, coercive field strength $H_s$, remanence ratio $J_r/J_s$ and non-linearity factor NL of a composition $Fe_{75.5}Cu_1Nb_{1.5}Si_{15.5}B_{6.5}$ after heat treatment for approximately 4 seconds under a tensile stress of approximately 50 MPa as a function of the annealing temperature. As shown in FIG. 2, the anisotropic field $H_a$ corresponds to the field in which the linear region of the hysteresis loop becomes saturated.

As illustrated by hatching in the diagram, the annealing temperatures between which the desired properties can be achieved lie in the range of approximately 535° C. to 670° C.

The hatched area shows the region of linear loops with low saturation magnetostriction, high anisotropic field and low remanence ratio. This is also the region in which the alloys have particularly linear loops. Thus in the embodiment disclosed in FIG. 5 the most suitable annealing temperature lies between 535° C. and 670° C.

These temperature limits are largely independent of the level of tensile stress. They are, however, dependent on the length of heat treatment and Nb content. Thus, for example, as shown in FIG. 6 and Table 2, they fall as the Nb content falls or the length of heat treatment increases.

Figure 6:
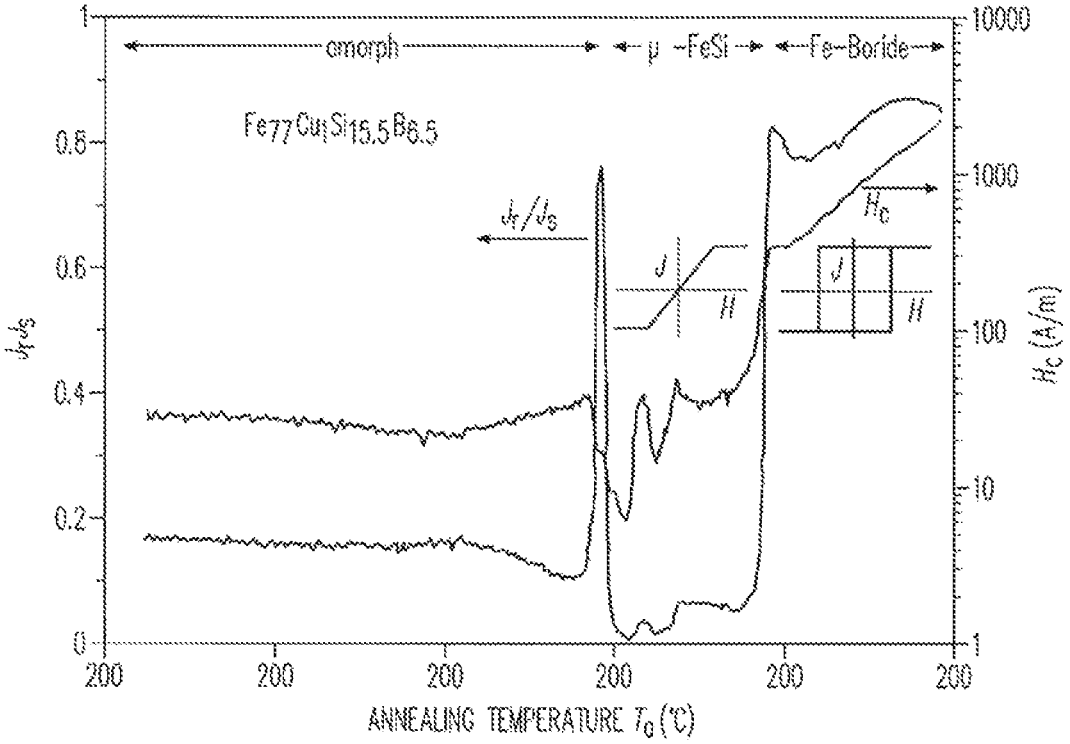
FIG. 6 shows a diagram of the remanence ratio $J_r/J_s$ and coercive field strength $H_c$ of the alloy $Fe_{77}Cu_1Si_{15.5}B_{6.5}$ after heat treatment under tensile stress.

FIG. 6 shows the annealing behaviour of a niobium-free alloy variant for which the optimum annealing temperature lies in the range of approximately 500° C. to 570° C., i.e. significantly below that of the composition shown in FIG. 5. In particular, FIG. 6 shows a diagram of the remanence ratio $J_r/J_s$ and the coercive field strength $H_c$ of the alloy $Fe_{77}Cu_1Si_{15.5}B_{6.5}$ after heat treatment for 4 seconds at $T_a$=613° C. under a tensile stress of approximately 50 MPa. Here the optimum annealing temperatures disclosed lie within the range of approximately 500° C. to 570° C. As shown schematically in the inset, this gives a flat linear hysteresis loop with a remanence ratio of less than 0.1.

Figure 7:
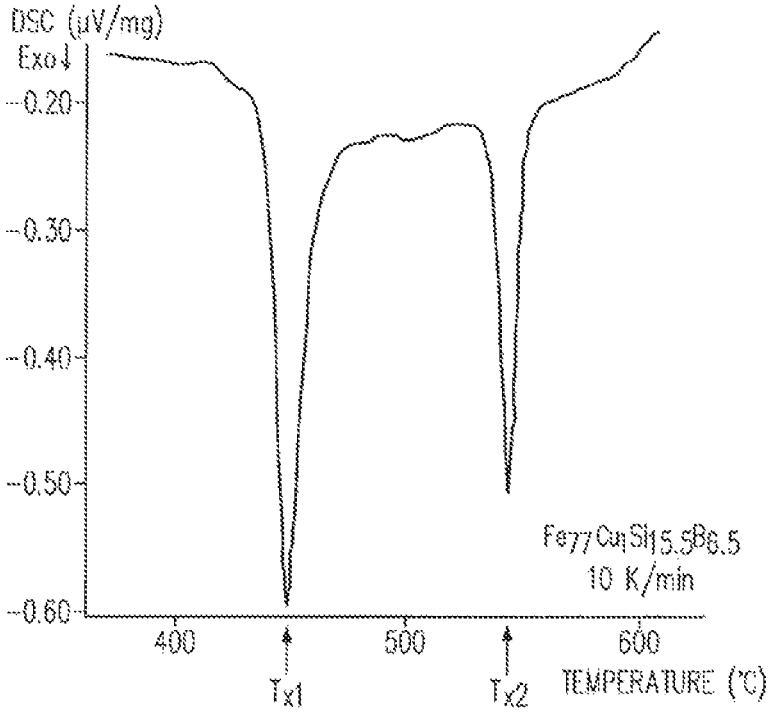
FIG. 7 shows the crystalline behaviour measured using Differential Scanning calorimetry (DSC) at a heating rate of 10 K/min of the alloy $Fe_{77}Cu_1Si_{15.5}B_{6.5}$ and the definition of the crystallisation temperatures $T_{x1}$ and $T_{x2}$.

FIG. 7 shows crystallisation behaviour measured by Differential Scanning calorimetry (DSC) at a heating rate of 10 K/min using the example of the alloy $Fe_{77}Cu_1Si_{15.5}B_{6.5}$. It shows two crystallisation stages characterised by crystallisation temperatures $T_{x1}$ and $T_{x2}$. Here the temperature range delimited by $T_{x1}$ and $T_{x2}$ in the DSC measurement corresponds to the optimum annealing temperature range which lies between 500° C. and 570° C. for this alloy as shown in FIG. 6.

Figure 8:
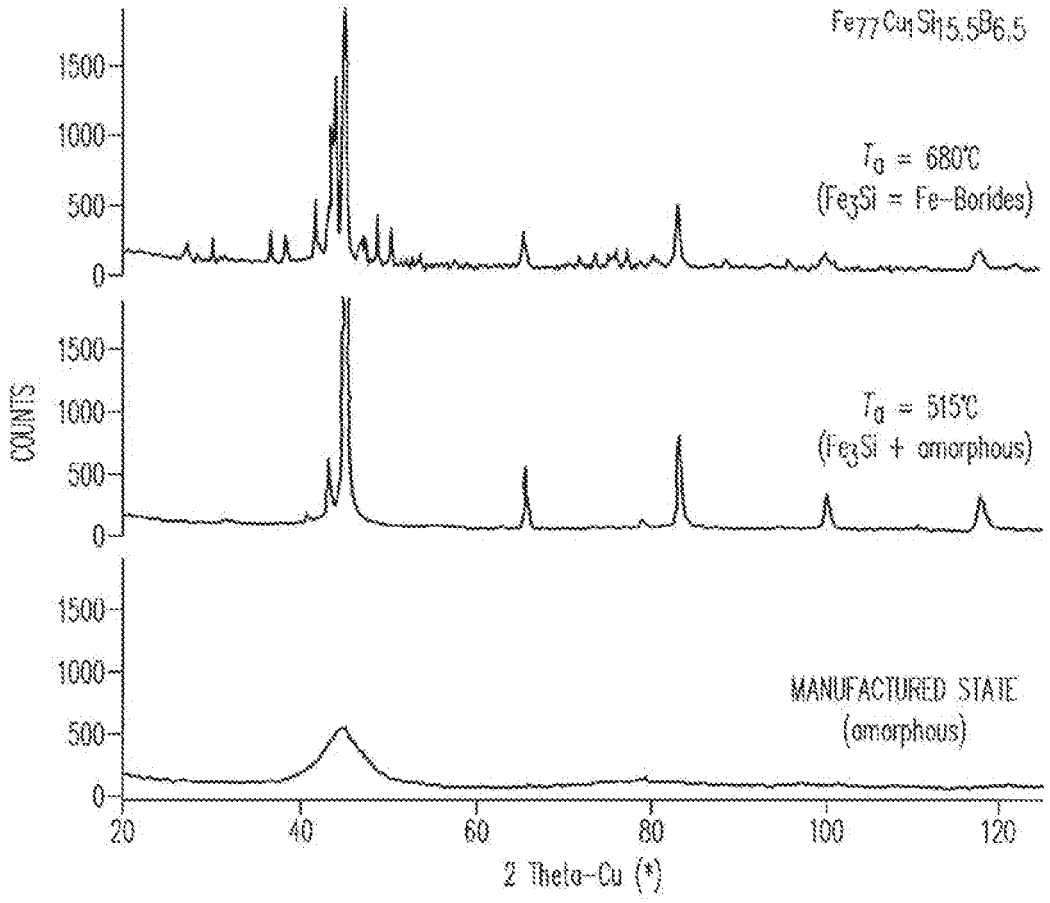
FIG. 8 shows the X-ray diffraction diagram for the alloy $Fe_{77}Cu_1Si_{15.5}B_{6.5}$ in its amorphous starting state and after heat treatment under stress at different annealing temperatures in different crystallisation stages.

FIG. 8 shows the X-ray diffraction diagram for the alloy $Fe_{77}Cu_1Si_{15.5}B_{6.5}$ in its amorphous original state and after heat treatment under stress at different annealing temperatures corresponding to the different crystallisation stages defined by $T_{x1}$ and $T_{x2}$. In particular, FIG. 8 shows the X-ray diffraction diagram after heat treatment under stress for 4 s at 515° C., i.e. in the annealing range in which the magnetic properties disclosed in the invention are achieved, and at 680° C., i.e. in the unfavourable annealing range in which linear hysteresis loops with low remanence ratios are no longer produced.

Analysis of the maximum diffraction values reveals that at annealing temperatures producing linear hysteresis loops with low remanence ratios the only crystallites to form in the crystalline phase are essentially cubic Fe—Si crystallites embedded in an amorphous minority matrix. In the case of the alloy $Fe_{77}Cu_1Si_{15.5}B_{6.5}$ the average size of these crystallites lies in a range of approximately 38 to 44 nm. If the same analysis is carried out with the alloy composition $Fe_{75.5}Cu_1Nb_xSi_{15.5}B_{6.5}$ the average crystallite size achieved with the corresponding optimum annealing temperatures lies in the range of 20 to 25 nm. In the second stage of crystallisation, boride phases, which have an unfavourable effect on magnetic properties and lead to a non-linear loop with a high remanence ratio and high coercive field strength, crystallise out of the amorphous residual matrix.

Table 2 shows further examples and additional data in the form of the crystallisation temperatures $T_{x1}$ and $T_{x2}$ measured at 25 10K/min by means of Differential Scanning calorimetry (DSC) which correspond to the crystallisation of bcc-FeSi and borides respectively. The suitable annealing temperature lies approximately between $T_{x1}$ and $T_{x2}$ and results in a structure of nanocrystalline grains with an average grain size of less than 50 nm embedded in an amorphous matrix and the desired magnetic properties.

TABLE 2

| Nb (at %) | $T_{x1}$ (° C.) | $T_{x2}$ (° C.) | optimum annealing temperature $T_a$ |
|---|---|---|---|
| 0 | 450 | 544 | 500° C. to 570° C. |
| 0.5 | 457 | 578 | 510° C. to 620° C. |
| 1.5 | 486 | 653 | 535° C. to 670° C. |
| 3.0 | 527 | 707 | 580° C. to 720° C. (Control example) |

However, $T_{x1}$ and $T_{x2}$ and the annealing temperatures $T_a$ are dependent on the heating rate and length of the heat treatment. For this reason the optimum annealing temperatures for heat treatments of less than 10 seconds are higher than the crystallisation temperatures $T_{x1}$ and $T_{x2}$ measured using Differential Scanning calorimetry (DSC) at 10K/min shown in Table 2. Accordingly, the optimum annealing temperatures $T_a$ for longer annealing times of 10 min to 60 min, for example, are typically 50° C. to 100° C. lower than the $T_a$ values listed in Table 2 for a heat treatment of a few seconds.

Accordingly, the annealing temperatures $T_a$ can be adapted to the composition and length of the heat treatment as required according to the teaching of FIG. 5 and using the crystallisation temperatures measured using Differential Scanning calorimetry as per Table 2.

Table 3 shows the influence of annealing time using the example of an alloy of composition $Fe_{76}Cu_1Nb_{1.5}Si_{13.5}B_8$. Annealing times in the range of a few seconds to a few minutes show no significant influence on the resulting magnetic properties. This applies as long as the annealing temperature $T_a$ lies between the limit temperatures discussed in Table 2. In this embodiment they are $T_{x1}$=489° C. and $T_{x2}$=630° C. measured using Differential Scanning calorimetry at 10 K/min or $T_a1$=540° C. and $T_a2$=640° C. for heat treatment lasting 4 seconds.

TABLE 3

| Annealing time $t_a$ (sec) | Non-linearity NL (%) | Remanence ratio $J_r/J_s$ | Coercive field strength $H_c$ (A/m) | Anisotropic field $H_a$ (A/m) | Permeability μ |
|---|---|---|---|---|---|
| 3 | 0.03 | <0.001 | 3 | 2970 | 363 |
| 4 | 0.04 | <0.001 | 4 | 2860 | 377 |
| 5 | 0.04 | <0.001 | 4 | 2870 | 376 |
| 13 | 0.04 | <0.001 | 5 | 2950 | 365 |
| 32 | 0.08 | <0.001 | 4 | 2970 | 363 |

In this embodiment the annealing temperature is $T_a$=610° C. and thus falls between the upper and lower values of the two limit temperature defined. The crystallisation temperatures measured at a heating rate of 10 K/min correspond approximately to the optimum annealing range for isothermal heat treatment lasting a few minutes.

Figure 9:
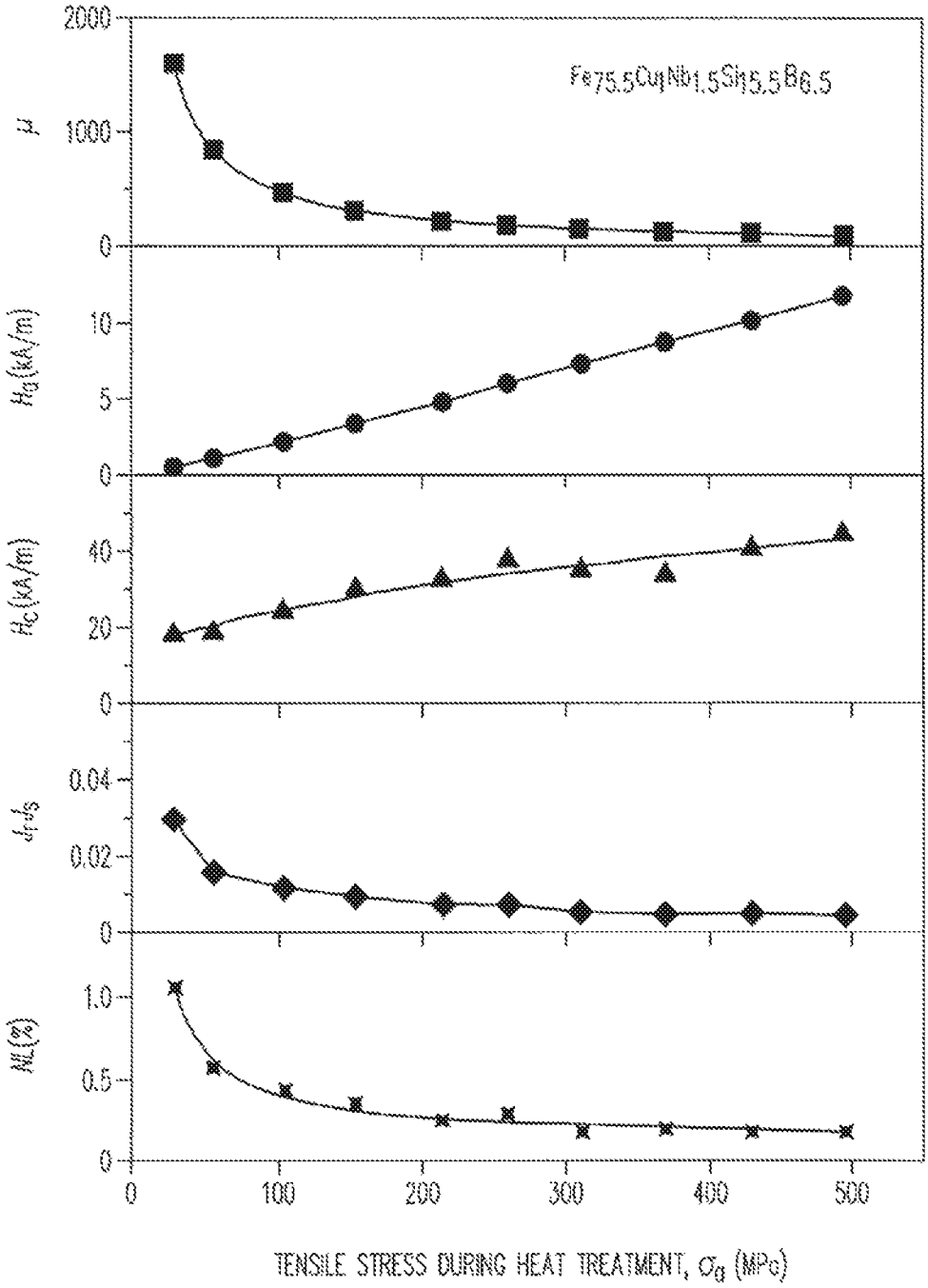
FIG. 9 shows a diagram of the permeability μ, anisotropic field $H_a$, coercive field strength $H_c$, remanence ratio $J_r/J_s$ and non-linearity factor NL of nanocrystalline $Fe_{75.5}Cu_1Nb_{1.5}Si_{15.5}B_{6.5}$ after heat treatment under the specified tensile stress $\sigma_a$.

FIG. 9 shows the dependence of permeability, anisotropic field, coercive field strength, remanence ratio and non-linearity factor on the tensile stress applied during heat treatment. In particular, FIG. 9 shows a diagram the permeability, anisotropic field, coercive field strength, remanence ratio and non-linearity factor of nanocrystalline $Fe_{75.5}Cu_1Nb_{1.5}Si_{15.5}B_{6.5}$ after heat treatment for 4 seconds at 613° under the specified tensile stress $\sigma_a$. In all cases this produced a remanence ratio of typically less than $J_r/J_s<0.04$ and a non-linearity factor of less than 2%.

Table 4 shows a further example of the dependence of permeability, anisotropic field, coercive field strength, remanence ratio and non-linearity factor on the tensile stress applied during heat treatment. In particular, the table shows the permeability, anisotropic field, coercive field strength, remanence ratio and non-linearity factor of nanocrystalline $Fe_{76}Cu_{0.5}Nb_{1.5}Si_{15.5}B_{6.5}$ after heat treatment for 4 seconds at 605° C. under the specified tensile stress $\sigma_a$. In all cases, this produced a remanence ratio of typically less than $J_r/J_s<0.1$ and a non-linearity factor of less than 3%.

TABLE 4

| Annealing time $\sigma_a$ (sec) | Non-linearity NL (%) | Remanence ratio $J_r/J_s$ | Coercive field strength $H_c$ (A/m) | Anisotropic field $H_a$ (A/m) | Permeability μ |
|---|---|---|---|---|---|
| 4.5 | 2.8 | 0.09 | 10 | 122 | 8730 |
| 7.2 | 1.7 | 0.05 | 8 | 168 | 6350 |
| 16 | 0.6 | 0.02 | 9 | 405 | 2630 |
| 27 | 0.3 | 0.01 | 9 | 781 | 1370 |
| 52 | 0.2 | 0.008 | 11 | 1490 | 715 |
| 105 | 0.07 | 0.004 | 12 | 3110 | 343 |
| 155 | 0.08 | 0.004 | 16 | 4560 | 234 |

FIG. 9 and Table 4 show that anisotropic field strength $H_a$ and permeability μ can be set accurately by adjusting tensile stress σa. Achieving a predetermined anisotropic field strength Ha or permeability μ value requires a tensile stress σa≈αμ0Ha/Js or σa≈α/μ, during heat treatment, where μ0=(4π 10−7 Vs/(Am)) is the magnetic field constant. Here a indicates a material parameter which depends primarily on the alloy composition but can also depend on annealing temperature and annealing time. Typical values lie within the range α≈30000 MPa 10 to α≈70000 MPa. In particular, the example shown in FIG. 9 results in a value of α≈48000 MPa and that shown in Table 3 in a value of α≈36000 MPa.

The embodiments in FIG. 9 and Table 3 also illustrate that the lower the permeability set, the greater the linearity of the loops. Thus permeabilities of less than approximately μ=3000 result in particularly linear loops with a non-linearity of less than 2% and a remanence ratio of $J_r/J_s<0.05$.

The tapes in the preceding embodiments comprise an alloy with the composition (in at %)

$Fe_{100-a-b-c-d-x-y-z}Cu_aNb_bM_cT_dSi_xB_yZ_z$, where

Cu $0\le a<1.5$,

Nb $0\le b<2$,

M is one or more of the elements Mo, Ta, or Zr with $0\le b+c<2$,

T is one or more of the elements V, Mn, Cr, Co or Ni with $0\le d<5$,

Si $10<x<18$

B $5<y<11$

Z is one or more of the elements C, P or Ge with $0\le z<2$,

With the alloy containing up to 1 at % impurities. Typical impurities are C, P, S, Ti, Mn, Cr, Mo, Ni and Ta.

Under certain heat treatments composition can exert an influence on magnetic properties. It is possible to adjust the heat treatment, and in particular the tensile stress, in order to achieve the desired magnetic properties of a given composition.

Figure 10:
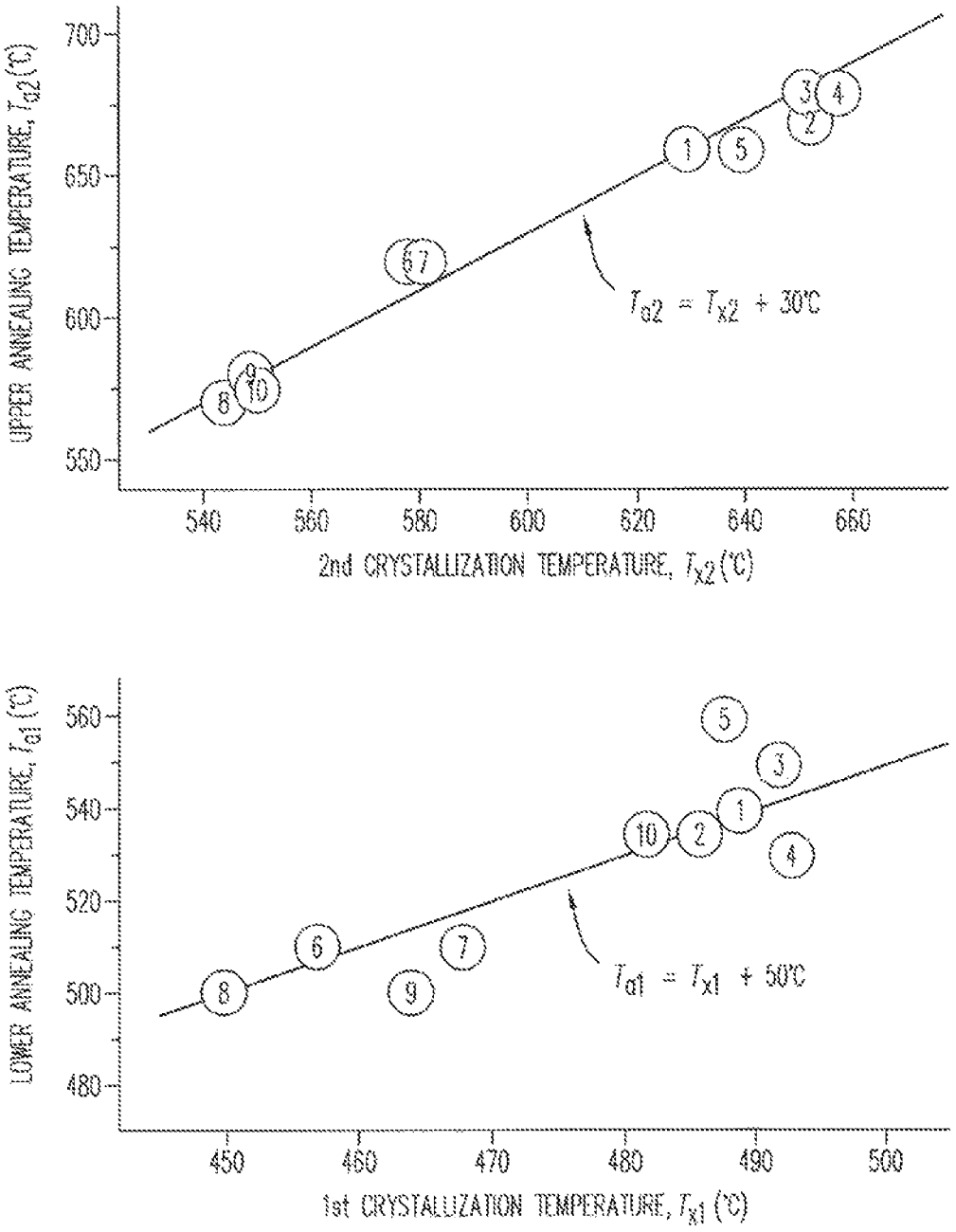
FIG. 10 shows the lower and upper optimum annealing temperatures $T_{a1}$ and $T_{a2}$ for different alloy compositions as a function of the crystallisation temperatures $T_{x1}$ and $T_{x2}$.

Table 5 shows examples of alloys which have been heat treated for approximately 4 seconds under a tensile stress of 50 MPa at an optimum annealing temperature $T_a$ for the composition in question and a control example with a composition containing a niobium content of over 2 at %. The other examples, numbered consecutively 1 to 10, represent compositions disclosed in the invention with a Nb content of less than 2 at %. In addition, FIG. 10 shows the optimum annealing and crystallisation temperatures of alloy examples 1 to 10. In particular, FIG. 10 shows the upper and lower optimum annealing temperatures $T_{a1}$ and $T_{a2}$ for an annealing time of 4 s as a function of the crystallisation temperatures $T_{x1}$ and $T_{x2}$ measured using DSC at 10 K/min.

TABLE 5

| | Composition (at %) | $J_s$ (T) | $T_a$ (° C.) | NL (%) | $J_r/J_s$ | $H_c$ (A/m) | $H_a$ (A/m) | μ |
|---|---|---|---|---|---|---|---|---|
| (a) | $Fe_{74}Cu_1Nb_3Si_{15.5}B_{6.5}$ | 1.21 | 690 | 0.3 | 0.004 | 3 | 850 | 1130 |
| 1 | $Fe_{76}Cu_1Nb_{1.5}Si_{13.5}B_8$ | 1.35 | 610 | 0.5 | 0.005 | 5 | 950 | 1140 |
| 2 | $Fe_{75.5}Cu_1Nb_{1.5}Si_{15.5}B_{6.5}$ | 1.34 | 610 | 0.6 | 0.01 | 13 | 1240 | 780 |
| 3 | $Fe_{72.5}Co_3Cu_1Nb_{1.5}Si_{15.5}B_{6.5}$ | 1.33 | 600 | 1.2 | 0.016 | 11 | 680 | 1550 |
| 4 | $Fe_{74.5}Cu_1Nb_{1.5}Si_{16.5}B_{6.5}$ | 1.31 | 630 | 0.4 | 0.007 | 6 | 950 | 1100 |
| 5 | $Fe_{75.5}Cu_{0.5}Nb_{1.5}Si_{17.5}B_{5.5}$ | 1.31 | 645 | 1 | 0.02 | 22 | 1050 | 990 |
| 6 | $Fe_{76.5}Cu_1Nb_{0.5}Si_{15.5}B_{6.5}$ | 1.41 | 600 | 0.9 | 0.013 | 14 | 1020 | 1100 |
| 7 | $Fe_{75.5}Cu_1Nb_{0.5}Si_{16.5}B_{6.5}$ | 1.40 | 575 | 0.5 | 0.008 | 8 | 970 | 1150 |
| 8 | $Fe_{77}Cu_1Si_{15.5}B_{6.5}$ | 1.46 | 525 | 1 | 0.016 | 17 | 1070 | 1080 |
| 9 | $Fe_{75}Cu_1Si_{17.5}B_{6.5}$ | 1.41 | 510 | 1.5 | 0.017 | 23 | 1400 | 800 |
| 10 | $Fe_{80}Si_{11}B_9$ | 1.54 | 565 | 0.5 | 0.013 | 12 | 925 | 1320 |

(a) Control examples 1-10 examples according to the invention

These examples demonstrate that the composition of the alloys disclosed in the invention can be varied within certain limits. Within the limits indicated above (1), elements such as Mo, Ta and/or Zr can be added to the alloy in place of Nb, (2) transition metals such as V, Mn, Cr, Co and/or Ni can be added to the alloy in place of Fe and/or (3) elements such as C, P and/or Ge can be added to the alloy without changing the properties significantly. To corroborate this finding, in a further embodiment the alloy composition $Fe_{71.5}Co_{2.5}Ni_{0.5}Cr_{0.5}V_{0.5}Mn_{0.2}Cu_{0.7}Nb_{0.5}Mo_{0.5}Ta_{0.4}Si_{15.5}B_{6.5}C_{0.2}$ was produced in a tape 20 μm thick and 10 mm wide. The alloy has a saturation polarisation of $J_s$=1 0.25 T and reacts to heat treatment under tensile stress in a similar way to example alloys 2 to 5 in Table 3 for example. Thus heat treatment lasting approximately 4 s at 600° C. under a tensile stress of 50 MPa results in a non-linearity factor of 0.4%, a remanence ratio of $J_r/J_s$=0.01, a coercive field strength of $H_c$=6 A/m, an anisotropic field of $H_a$=855 A/m and a permeability value of μ=1160.

Table 5 shows that desirable magnetic properties are also achieved without the addition of Cu.

Table 6 therefore shows further example alloys in which the Cu content is systematically varied and heat treatment is carried out for approximately 7 seconds at 600° C. under a tensile stress of approximately 15 MPa. In particular, in Table 6 the element Fe was replaced step by step with Cu while the other alloy components remained unchanged.

TABLE 6

| Composition (at %) | $J_s$ (T) | NL (%) | $J_r/J_s$ | $H_c$ (A/m) | $H_a$ (A/m) | μ |
|---|---|---|---|---|---|---|
| 11 $Fe_{76.5}Nb_{1.5}Si_{15.5}B_{6.5}$ | 1.35 | 0.2 | 0.02 | 5 | 332 | 2990 |
| 12 $Fe_{76.3}Cu_{0.2}Nb_{1.5}Si_{15.5}B_{6.5}$ | 1.35 | 0.3 | 0.02 | 6 | 371 | 2890 |
| 13 $Fe_{76}Cu_{0.5}Nb_{1.5}Si_{15.5}B_{6.5}$ | 1.34 | 0.8 | 0.03 | 10 | 374 | 2850 |
| 14 $Fe_{75.1}Cu_{1.4}Nb_{1.5}Si_{15.5}B_{6.5}$ | 1.33 | 1.2 | 0.03 | 10 | 375 | 2820 |
| 15 $Fe_{74.5}Cu_2Nb_{1.5}Si_{15.5}B_{6.5}$ | 1.32 | Critical for production and processing | | | | |

Table 6 shows no significant influence of the Cu content on the magnetic properties for Cu contents below 1.5 at %. However, the addition of Cu promotes the tendency of the tapes to brittleness during production. In particular, alloys with Cu contents greater than 1.5 at % (such as alloy no. 15 in Table 6, for example) show high brittleness in the manufactured state. For example, a 20 μm thick tape of the alloy $Fe_{74.5}Cu_2Nb_{1.5}Si_{15.5}B_{6.5}$ can crack at a bending diameter of approximately 1 mm.

Due to the high tape speeds reached during production (25 to 30 m/s), it is impossible or very difficult to catch a tape this brittle during the casting process and wind it immediately as it leaves the cooling roller. This makes the production of the tape uneconomical. In addition, many such tapes (being brittle from the outset) crack during heat treatment, in particular before they reach the higher temperature zone. When such cracks occur, the heat treatments process is interrupted and the tape has to be passed through the oven again.

In contrast, alloys with a Cu content of less than 1.5 at % can be bent to a bending diameter of twice the tape thickness, i.e. typically less than 0.06 mm, without breaking. This allows the tape to be wound up directly during casting. In addition, the heat treatment of such tapes, which are ductile from the outset, is considerably simpler. Alloys with a Cu content of less than 1.5 at % embrittle during heat treatment, but not until they have left the oven and cooled. The probability of a tape cracking during heat treatment is thus significantly lower. In addition, in most cases tape transport through the oven can continue despite the crack. Overall, tapes which are ductile from the outset can be both produced and heat treated with fewer problems and thus more economically.

The compositions shown in Tables 5 and 6 are nominal compositions in at % which correspond to the concentrations of individual elements found in the chemical analysis to an accuracy of typically ±0.5 at %.

Silicon and boron contents also exert an influence on the magnetic properties of this type of nanocrystalline alloy with a niobium content of less than 2 at % if they are produced under tensile stress.

The examples given in Tables 3 to 6 have the following desired combinations of properties: a magnetisation loop with a linear central region, a remanence ratio $J_r/J_s<0.1$ and a low coercive field strength He which typically represents only a few percent of the anisotropic field strength $H_a$.

Figure 11:
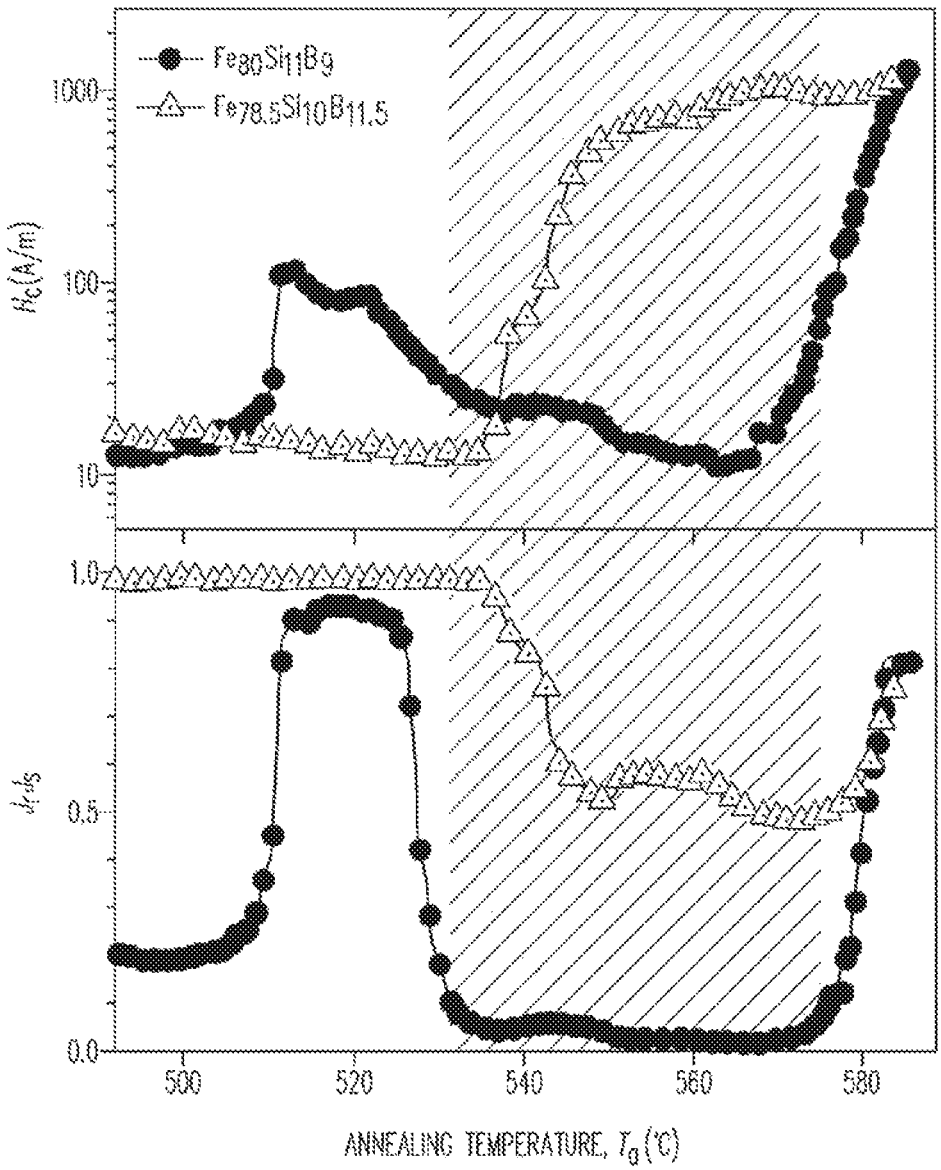
FIG. 11 shows a diagram of the coercive field strength $H_c$ and remanence ratio $J_r/J_s$ of the alloy $Fe_{80}Si_{11}B_9$ and a control composition $Fe_{75.5}Si_{10}B_{11.5}$ after heat treatment under tensile stress.
Figure 12:
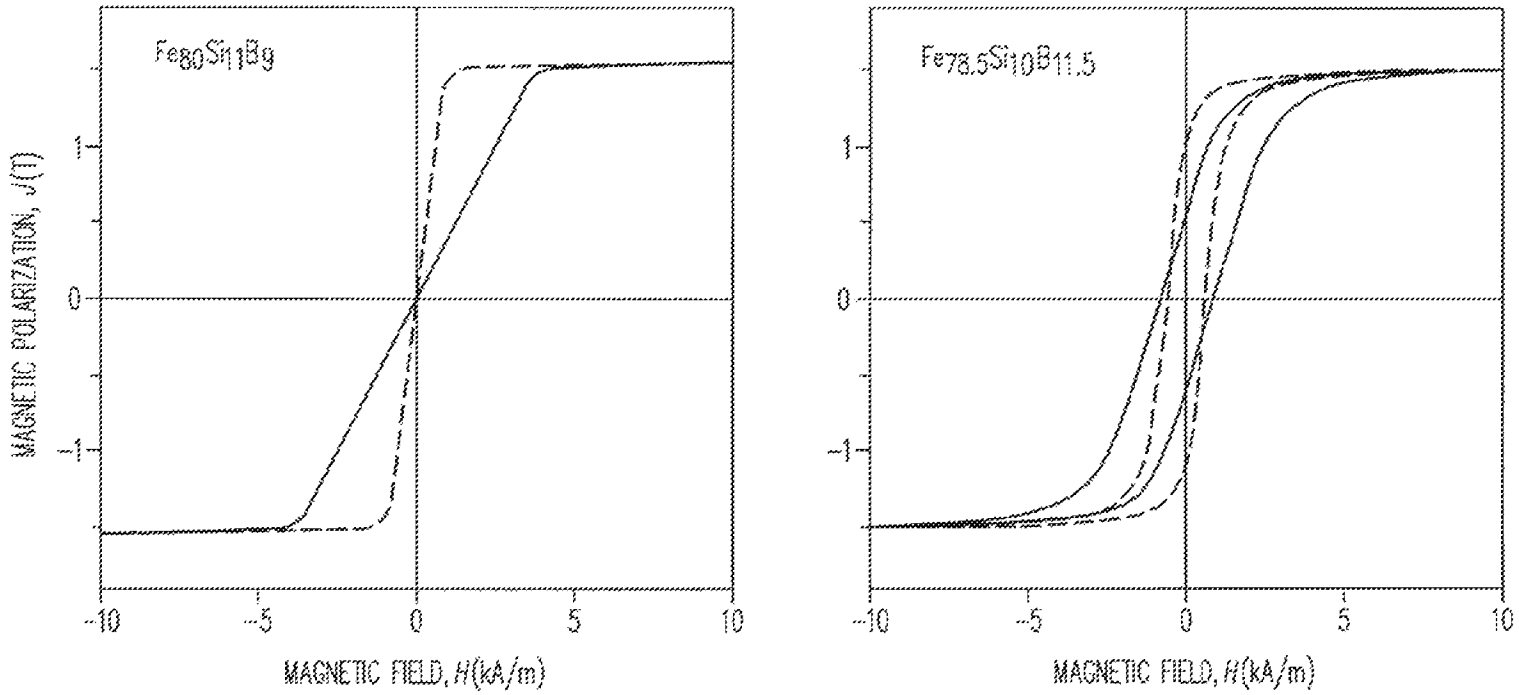
FIG. 12 shows a diagram of hysteresis loops for an alloy $Fe_{80}Si_{11}B_9$ and a control composition $F_{78.5}Si_{10}B_{11.5}$ after heat treatment under different tensile stresses.

FIGS. 11 and 12 compare the magnetic properties of the compositions $Fe_{80}Si_{11}B_9$ and $Fe_{78.5}Si_{10}B_{11.5}$. FIG. 11 shows a diagram of the coercive field strength $H_c$ and remanence ratio $J_r/J_s$ curves for both alloys after heat treatment under a tensile stress of approximately 50 MPa as a function of the annealing temperature $T_a$. The coercive field strength $H_c$ and remanence ratio $J_r/J_s$ of the alloy $Fe_{80}Si_{11}B_9$ disclosed in the invention, indicated by black circles, and of the control composition $Fe_{78.5}Si_{10}B_{11.5}$, indicated by white triangles, are shown after heat treatment for 4 seconds at the annealing temperature $T_a$ under a tensile stress of approximately 50 MPa.

FIG. 12 shows a diagram of hysteresis loops for the two alloys after heat treatment for 4 s at approximately 565° C. under tensile stresses of 50 MPa (broken line) and 220 MPa (continuous line). The hysteresis loop for the alloy $Fe_{80}Si_{11}B_9$ disclosed in the invention is shown on the left and that of the control composition $Fe_{78.5}Si_{10}B_{11.5}$ on the right. Although the alloys shown in FIGS. 11 and 12 differ only slightly in their chemical composition, there are significant differences in the magnetic properties of the two alloys.

For example, after heat treatment at between approximately 530° C. and 570° C. the composition $Fe_{80}Si_{11}B_9$ has a linear magnetisation loop with a low remanence ratio $J_r/J_s<0.1$ and a low coercive field strength which is significantly below 100 A/m and represents only a few percent of the anisotropic field strength $H_a$.

In contrast, the composition $Fe_{78.5}Si_{10}B_{11.5}$ has a high remanence ratio over the entire heat treatment range. Even the lowest remanence ratio values, which are achieved at annealing temperatures of between 540° C. and 570° C., are around $J_r/J_s<0.5$ (cf. FIG. 11). In addition, at these lowest $J_r/J_s$ values there is an unfavourably high coercive field strength of approximately $H_c\approx800$-1000 A/m. The central region of the magnetisation loop thus loses linearity and the significant divergence in the hysteresis loop leads to disadvantageously high hysteresis losses (cf. FIG. 12).

These embodiments show that after heat treatment under tensile stress alloy compositions with a Si content of more than 10 at % and a B content of less than 11 at % produce a flat, largely linear hysteresis loop with a remanence ratio $J_r/J_s<0.1$ and a low coercive field strength which is significantly below 100 A/m and represents no more than 10% of the anisotropic field. Where the silicon content is lower and the boron content higher than these limit values, the desired magnetic properties are not achieved after such heat treatment under tensile stress.

The upper Si content limit and the lower B content limit are also examined. While the alloy composition $Fe_{75}Cu_{0.5}Nb_{1.5}Si_{17.5}B_{5.5}$ (see alloy no. 5 in Table 5) could be produced as an amorphous ductile tape without difficulty and had desirable properties following heat treatment, after heat treatment the alloy composition $Fe_{75}Cu_{0.5}Nb_{1.5}Si_{18}B_5$ presented only borderline magnetic properties and the alloy composition $Fe_{75}Cu_{0.5}Nb_{1.5}Si_{18.5}B_{4.5}$ could no longer be produced as a ductile amorphous tape.

The embodiments show that after heat treatment under tensile stress alloy compositions with a Si content of less than 18 at % and a B content of more than 5 at % produce a flat, largely linear hysteresis loop with a remanence ratio $J_r/J_s<0.1$ and a low coercive field strength which is significantly below 100 A/m and represents no more than 10% of the anisotropic field. Where the silicon content is greater than 18 at % and the boron content less than 5 at %, the desired magnetic properties are not achieved or an amorphous and ductile tape can no longer be produced with such heat treatment under tensile stress.

Table 7 shows the saturation magnetostriction constant $\lambda_s$ for different alloy compositions measured in the manufactured state and after 4 s heat treatment under a stress of 50 MPa at the specified annealing temperature $T_a$. In particular, the annealing temperature selected was no more than 50° C. from the maximum possible annealing temperature $Ta_2$ in order to obtain particularly small magnetostriction values for a given composition (cf. FIG. 5), these values ultimately being determined by the alloy composition. The effect of the Si content is shown.

TABLE 7

| Composition (at %) | $\lambda_s$ (ppm) Manufactured state | $T_a$ (° C.) | $T_{a2} \cdot T_a$ (° C.) | $\lambda_s$ (ppm) after heat treatment at $T_a$ |
|---|---|---|---|---|
| $Fe_{80}Si_{11}B_9$ | 39 | 565 | 10 | 16 |
| $Fe_{76}Cu_1Nb_{1.5}Si_{13.5}B_8$ | 29 | 610 | 40 | 3.5 |
| $Fe_{75.5}Cu_1Nb_{1.5}Si_{15.5}B_{6.5}$ | 29 | 635 | 35 | 0.6 |
| $Fe_{74.5}Cu_1Nb_{1.5}Si_{16.5}B_{6.5}$ | 30 | 630 | 50 | 0.1 |
| $Fe_{75}Cu_{0.5}Nb_{1.5}Si_{17.5}B_{5.5}$ | 29 | 645 | 15 | −1.8 |

As a complement to Table 7, FIG. 5 demonstrates that heat treatment under tensile stress results in a clear reduction in saturation magnetostriction which can in turn lead to reproducible magnetic properties. In particular, by low magnetostriction, mechanical stresses have no or only a minor influence on the hysteresis loop. Such mechanical stresses may occur if the heat treated tape is wound into a magnetic core or if in the course of further processing the magnetic core is embedded in a trough or plastic mass to protect it or is subsequently provided with wire coils. This can be used to devise particularly advantageous compositions, i.e. compositions with low magnetostriction.

As demonstrated by the examples given in Table 7, particularly advantageous magnetostriction values in terms of amount of less than 5 ppm can be achieved if the Si content is greater than 13 at % and the heat treatment temperature is not more than 50° C. below the upper limit $Ta_2$ of the optimum annealing range. Even smaller saturation magnetostriction values in terms of amount of less than 2 ppm can be achieved if the Si content is greater than 14 at % and less than 18 at % and the heat treatment temperature is not more than 50° C. below the upper limit $Ta_2$ of the optimum annealing range. Even lower saturation magnetostriction values in terms of amount of less than 1 ppm can be achieved if the Si content is greater than 15 at % and the heat treatment temperature is not more than 50° C. below the upper limit $Ta_2$ of the optimum annealing range.

The higher the permeability, the more important a small magnetostriction value in terms of amount. For example, alloys with a permeability value greater than 500, or greater than 1000, have a comparatively low dependence on mechanical stresses if the saturation magnetostriction in terms of amount is less than 2 ppm or less than 1 ppm.

The alloy can also have a saturation magnetostriction in terms of amount of less than 5 ppm. Alloys with a saturation magnetostriction below this limit value continue to have good soft magnetic properties even where there is internal stress if the permeability is less than 500.

The saturation magnetostriction value may still depend to a small extent on the tensile stress $\sigma_a$ applied during heat treatment. For example, the following values are measured for the alloy $Fe_{75.5}Cu_1Nb_{1.5}Si_{15.5}B_{6.5}$ after heat treatment of 4 s at 610° C. dependent on the annealing stress: $\lambda_s \approx 1$ ppm at $\sigma_a \approx 50$ MPa, $\lambda_s \approx 0.7$ ppm at $\sigma_a \approx 260$ MPa and $\lambda_s \approx 0.3$ ppm at $\sigma_a \approx 500$ MPa. This corresponds to a small reduction in magnetostriction von $\Delta\lambda_s \approx -0.15$ ppm/100 MPa. The other alloy compositions show comparable behaviour.

Figure 13:
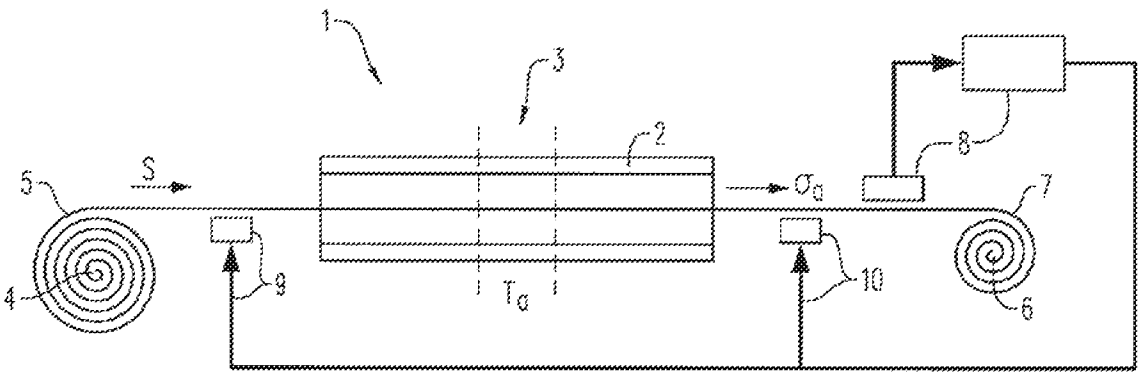
FIG. 13 shows a schematic view of a continuous furnace.

FIG. 13 shows a schematic view of a device 1 suitable for producing an alloy with a composition in accordance with one of the preceding embodiments in tape form. The device 1 comprises a continuous furnace 2 with a temperature zone 3, this temperature zone being set such that the temperature in the oven in this zone is within 5° C. of the annealing temperature $T_a$. The device 1 also comprises a coil 4 on which the amorphous alloy 5 is wound, and a take-up coil 6 which takes up the heated treated tape 7. The tape passes from the coil 4 through the continuous furnace 2 to the receiving coil 6 at a speed s. In the process the tape 7 is subject to a tensile stress $\sigma_a$ exerted in the direction of travel and in the region between tension device 9 and tensioning device 10.

The device 1 also comprises a device 8 for the continuous measurement of the magnetic properties of the tape 6 after it has been heat treated and removed from the continuous furnace 2. The tape 7 is no longer under tensile stress in the area of this device 8. The measured magnetic properties can be used to adjust the tensile stress σa under which the tape 7 is passed through the continuous furnace 2. This is shown schematically in FIG. 13 by means of the arrows 9 and 10. This measurement of the magnetic properties and continuous adjustment of the tensile stress can improve the regularity of the magnetic properties along the length of the tape.

The invention having been thus described by reference to certain examples and specific embodiments, it will be recognized that these are intended to illustrate, but not limit, the scope of the appended claims.

The invention claimed is:

1. An alloy, consisting of $Fe_{100-a-b-c-d-x-y-z}Cu_aNb_bM_cT_dSi_xB_yZ_z$ and up to 1 at % impurities, wherein M is one or more of the elements Mo, Ta or Zr, T is one or more of the elements V, Mn, Cr, Co or Ni, Z is one or more of the elements C, P or Ge, and wherein 0 at %≤a<1.5 at %, 0 at %≤b<2 at %, 0 at %≤(b+c)<2 at %, 0 at %≤d<5 at %, 10 at %<x<18 at %, 5 at %<y<11 at % and 0 at %≤z<2 at %, wherein the alloy is configured in tape form, wherein the alloy has a nanocrystalline structure in which at least 50% vol of the grains have an average size of less than 100 nm, and wherein the saturation polarization ($J_s$) of the alloy is in the range of 1.21 T to 1.54 T, wherein after heat treatment under tensile stress in a continuous furnace at temperatures in the range of 535° C. to 670° C., the alloy has a magnetic hysteresis loop with a central region, wherein the central region of the hysteresis loop is defined as the region of the hysteresis loop between the anisotropic field strength points which characterise the transition to saturation, the central region of the hysteresis loop having a linear region defined by a non-linearity factor NL of less than 3%, the non-linearity factor being calculated as follows:

$$NL(\%)=100(\delta Jup+\delta Jdown)/(2Js)$$

where δJup and δJdown are the standard deviation of magnetisation from a line of best fit through the rising (up) or falling (down) branches of the hysteresis loop between magnetisation values of ±75% of the saturation polarisation Js, wherein the hysteresis loop is a J-H hysteresis loop, the alloy exhibits a remanence ratio Jr/Js<0.05, Jr is remanent magnetization and Js is saturation polarization, and the alloy exhibits a ratio of coercive field strength Hc to anisotropic field strength Ha of <10%.

2. The alloy according to claim 1, wherein the saturation polarization (Js) of the alloy is 1.31 T to 1.54 T.

3. The alloy according to claim 2, wherein the saturation polarization (Js) of the ahoy is 1.40 T to 1.54 T.

4. The alloy in accordance with claim 1, wherein the ratio of coercive field strength to anisotropic field strength ratio is <5%.

5. The alloy in accordance with claim 1, wherein the alloy exhibits a permeability μ of between 40 and 3000.

6. The alloy in accordance with claim 1, wherein the alloy exhibits a saturation magnetostriction of less than 2 ppm.

7. The alloy in accordance with claim 1, wherein the alloy exhibits a permeability of less than 500 and a saturation magnetostriction of less than 5 ppm.

8. The alloy in accordance with claim 1, wherein b<0.5.

9. The alloy in accordance with claim 1, wherein a<0.5.

10. The alloy in accordance with claim 1, wherein 14 at %<x<17 at % and 5.5 at %<y<8 at %.

11. The alloy in accordance with claim 1, wherein the tape has a thickness of 10 μm to 50 μm.

12. The alloy in accordance with claim 1, wherein the nanocrystalline structure comprises at least 70% of the grains having an average size of less than 50 nm.

13. The alloy in accordance with claim 1, wherein the crystalline grains have an elongation of at least 0.02% in a preferred direction.

* * * * *